United States Patent [19]

Mack et al.

[11] 4,204,968

[45] May 27, 1980

[54] LUBRICANT ADDITIVE

[75] Inventors: Jack E. Mack; Patrick K. Mack, both of Littleton, Colo.

[73] Assignee: CLM International Corp., Englewood, Colo.

[21] Appl. No.: 932,863

[22] Filed: Aug. 11, 1978

[51] Int. Cl.[2] ..... C10M 1/54; C10M 3/48

[52] U.S. Cl. ..... 252/26

[58] Field of Search ..... 252/26

[56] References Cited

U.S. PATENT DOCUMENTS

| | | | |
|---|---|---|---|
| 1,658,173 | 2/1928 | Perks | 252/26 |
| 2,321,203 | 6/1943 | Henry et al. | 252/26 |
| 2,543,741 | 2/1951 | Zweifel | 252/26 |
| 3,549,531 | 12/1970 | Santt | 252/26 |
| 3,894,957 | 7/1975 | Lundin et al. | 252/26 |

*Primary Examiner*—Irving Vaughn

*Attorney, Agent, or Firm*—Max L. Wymore; Phillip L. DeArment

[57] ABSTRACT

This invention relates to a lubricant additive comprising a mixture of minute spherical copper and lead particles suspended in various lubricant bases depending upon its intended use. The minute spherical metal particles are presented to friction surfaces where they reduce friction by functioning as tiny ball bearings and platelets. In addition on the application of heat and pressure, the metal particles, particularly the copper particles, will plate on high wear areas where base metal has been removed by wear. The additive has been found to substantially reduce friction and wear between relatively moving parts.

17 Claims, 18 Drawing Figures

LUBRICANT ADDITIVE

BACKGROUND OF THE INVENTION

Numerous attempts have been made to provide lubricants having metal particles therein for the purpose of providing deposition of such metals on the metal bearing surfaces of engines to improve the lubricating qualities and especially the wear resistance of the lubricants. To date, none has been completely successful.

U.S. Pat. No. 3,894,957 is directed to a lubricating oil composition composed of finely divided particles of copper-lead alloy in powdered form in a carrier or base oil. Various ratios of copper to lead are set forth as contained in the alloy.

U.S. Pat. No. 3,532,623 shows the use of powdered copper or powdered lead in a dispersion medium wherein the metals are in the form of flakes.

U.S. Pat. No. 2,543,741 relates to lubricants which contain in combination, powdered copper, powdered lead and graphite. The copper particles are in the form of flakes and other shapes are disclosed as not being suitable.

U.S. Pat. No. 2,321,203 teaches various stabilizers for finely dispersed metals such as lead in lubricating compositions.

U.S. Pat. No. 2,160,911 shows greases containing colloidal lead.

U.S. Pat. No. 1,658,173 teaches lubricants containing copper or lead or zinc or other suitable metals as finely divided flocculent metal. The metals are disclosed as being of sponge form.

U.S. Pat. No. 269,636 teaches the use of an amalgam of mercury with copper and lead.

None of these prior art teachings is seen to teach applicant's novel lubricating composition.

DISCLOSURE OF THE INVENTION

This invention relates to compositions containing metal particles and more particularly to liquid compositions having metal particles suspended therein.

With today's modern engines and the need to improve and increase their efficiency, a search for improved lubricants for these engines continues. The additive of this invention is new and unique and takes advantage of a special, slippery particulate composition suspended in a petroleum based lubricant, although synthetic, mineral, hydrocarbon, silicon fluid or other suitable lubricant may find utility so long as it does not react with the metal particles.

It is an object of this invention to provide an additive to the crankcase oil of an engine that will have improved lubricating qualities, will provide a healing function for bearings and rubbing surfaces by deposition of metal thereon, will provide better sealing of bearings and moving parts and generally improve the efficiency of the engine operation.

It is still another and further object of the present invention to provide a lubricant additive which provides improved lubricating characteristics due to the ball bearing effect of the use of spherical metal particles.

A still further object of the present invention is to provide an improved lubricant additive which provides flattened metal platelets when subjected to the heat and pressure of engine operation which slide over each other in layered fashion to enhance the lubrication function.

A further object of the invention is to provide a lubricant additive that provides for improved lubrication and wear effect reduction that includes providing of metal plating, ball bearing effect and sliding platelets in its lubricating mechanism.

Other and further objects of the invention will be apparent from a reading of the specification and claims of this application when taken in conjunction with the drawings wherein:

Figure 1:
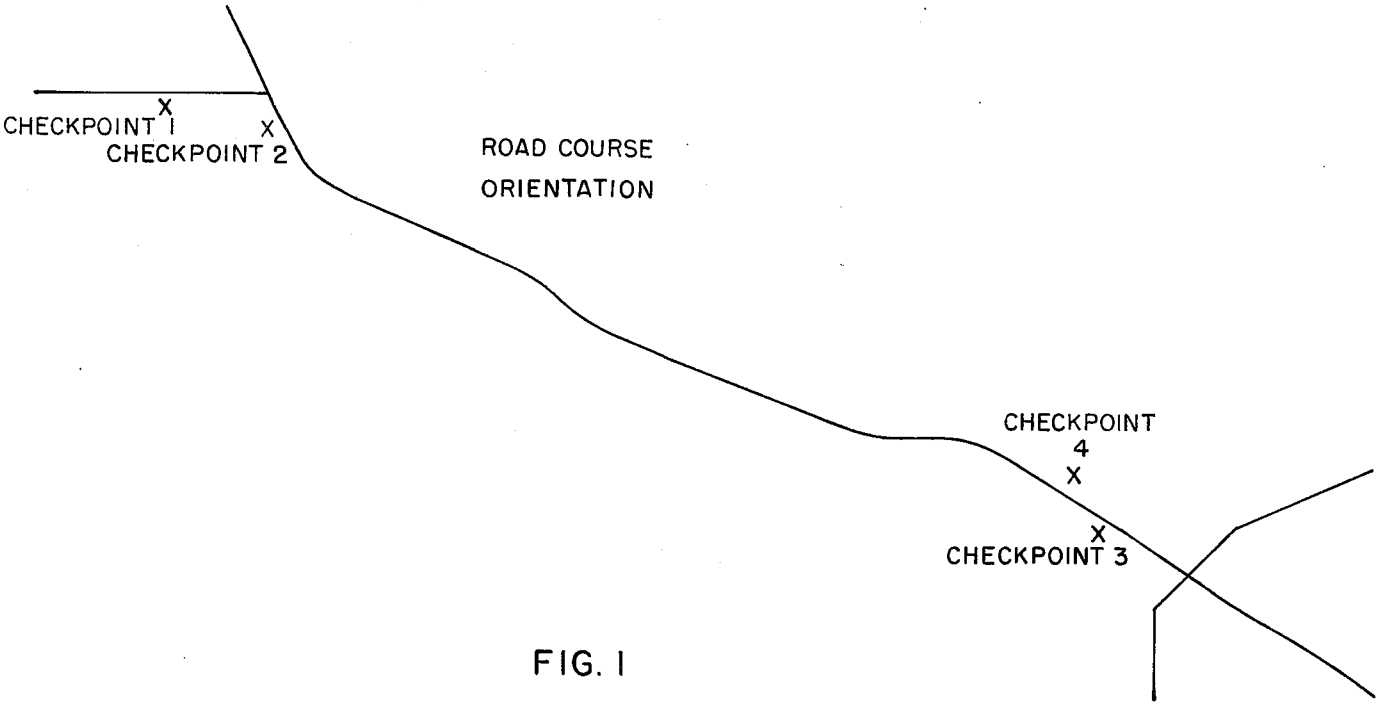
FIG. 1 is a representation of a test course over which test vehicles of the examples were driven in plan view.

Three mechanisms are believed to be mainly responsible for the improved results obtained with the lubricant additive of this invention. First is the fact that the minute metal particles of lead and copper are of spherical shape and provide a "ball bearing" effect in increasing the lubricity of the lubricant. The particles are very small and round and roll around like ball bearings. The second reason is that under conditions of high pressure and heat, the round particles flatten and form a system where the particles slide over each other. The third reason is that the metal particles of copper will plate out on high wear where base metal has been removed by wear.

The powdered copper and lead metals have particles that are spherical in shape such as copper and lead particles produced by the atomization-reduction process used by the Glidden Metals of Cleveland, Ohio. Other copper and lead metal powders may be used in this invention as long as they are spherical in shape. The powdered copper metal particles used in this invention must be spherical and may range in size from less than about 1 micron to about 8.2 microns in diameter. The powdered lead metal particles must also be spherical in shape and range from less than about 1 micron to about 2.7 microns in diameter. The copper and lead metal particles are treated with an oxidation depressant prior to introduction of the metal particles, into the base carrier to reduce the amount of oxidation occurring where metal is contacted by a hydrocarbon and thus the overall oxidation occurring in the system. The particle size of the lead and copper powder particles may be as high as about 15 to about 20 microns in diameter for some applications with an oil based carrier as long as the particles are not so large as to be trapped by an oil filter. Most oil filters used in automotive applications remove 75% of the particles that are greater than 20 microns. About 90% of the particles should be 20 microns or smaller in size for oils. For grease, particles from less than 1 micron up to 60 microns can be used as some greases are not circulated. The size of the particles is important from the standpoint of rate of plating and to insure that filters will not remove a substantial amount of metal particles before they plate.

The metal particles are principally copper and lead ranging from about 95% to about 99.5% of copper or lead by weight; however, trace amounts of other metals may be present as follows by weight:

| | |
|---|---|
| Tin | 0.10% to 2.0% |
| Antimony | 0.10% to 2.0% |
| Bismuth | 0.02% to 0.05% |
| Lithium | 0.10% to 2.0% |

These minor constituents represent impurities in commercially available grades of copper and lead powder and may provide some enhancement of the plating action.

Various ratios of copper to lead may be used depending upon the intended use. These ratios may vary from about 20% to about 80% copper and from about 80% to about 20% lead. The factors that determine the copper to lead ratios are: (1) Desired coefficient of friction (copper long term, lead short and intermediate term); (2) Heat transfer requirements; (3) Coating; and, (4) Filling of pores and voids.

The ratio of total weight of mixed metal powder to the base carrier is from about ½ ounce to about 3 ounces metal particles in 5 ounces of base carrier. The particular base depends upon what is to be lubricated. For example, for an automobile crankcase application, 1 to 2 ounces of metal particles, 20 micron or smaller, 60% copper, 40% lead, to 3 to 4 ounces of oil, a 40 w high premium motor oil is preferred. A small amount of grease may also be added for the purpose to be explained.

The factors affecting the selection of the ratio of metal to base are: (1) Area to be lubricated; (2) Degree of wear of surface; and, (3) Severity of use (high RPM, heavy loading).

An important aspect of the present invention is the obtaining of improved suspension of the metal particles in the oil base. It has been discovered that the addition of a specific amount of grease to the mixture of oil and metal particles causes the metal particles to remain in suspension and thus will not form a hard "cake" in the container or in the oil pan. Properly suspended, the metal particles merely settle and shaking the container places them in suspension.

The amount of grease to be added to the mixture of oil and metal particles depends upon the particle size of the metal particles as well as the type and viscosity of the base oil carrier. The smaller the size of the metal particles, the smaller the amount of grease that is required to be added to suspend the particles. Higher viscosity oils used as the base carrier will not require as much grease to suspend the particles. Metal particles as small as 0.2 microns in diameter will be suspended in 40 w oil without grease being added. The amount of grease added will range from about 1 pound of grease for from about 1 ounce to 32 ounces of metal particles. For crankcase applications, one would use the equivalent of about 1 pound of grease for each 32 ounces of metal particles. For a lubricant in the crankcase of a fractional horsepower motor for use on a lawn mower one would use the equivalent of about 1 pound of grease for each 16 ounces of metal particles. For use as a grease, one would add the equivalent of about 1 to about 2 ounces of metal particles to one pound of grease. In the above example of crankcase application where about 3 to 4 ounces of oil is used, 1¾ pounds of grease is used for each gallon of premium grade, 40 w oil. A suitable grease for this purpose is a high quality, multi-purpose grease, such as L2, an all purpose lithium based grease available from Phillips Petroleum Co. of Bartlesville, Oklahoma.

When the oil carrier is of a lesser viscosity, i.e. less than 40 w, such as a transmission fluid or hydraulic fluid, and the metal particles are 90% smaller than 10 microns, approximately, 1½ pounds of a high quality, multi-purpose grease is used for each gallon of the lighter oil used.

This invention will be illustrated in greater detail by reference to the following embodiments. A series of tests were set up and conducted under controlled conditions, both over the road and laboratory. In the over the road vehicle tests four different automobile engines were tested. The primary test engine was car #1. This car was extensively tested and at the end of the test sequence, the engine was disassembled and carefully inspected. Scanning electron microscopy was used to examine parts of the engine. The following procedures were used in performing the tests.

Gas Mileage Evaluation

Figure 2:
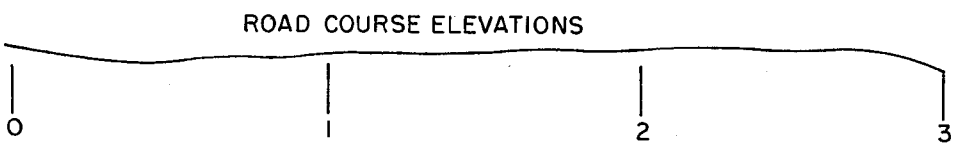
FIG. 2 is a representation of the test track of FIG. 1 in elevation.
Figure 3:
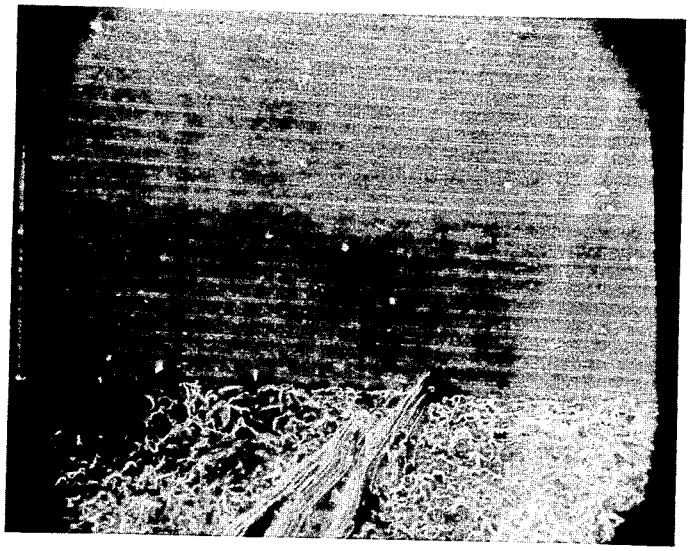
FIG. 3 is a photomicrograph of an edge view of a bearing after 75 hours additive use in a Briggs & Stratton engine—50X.
Figure 4:
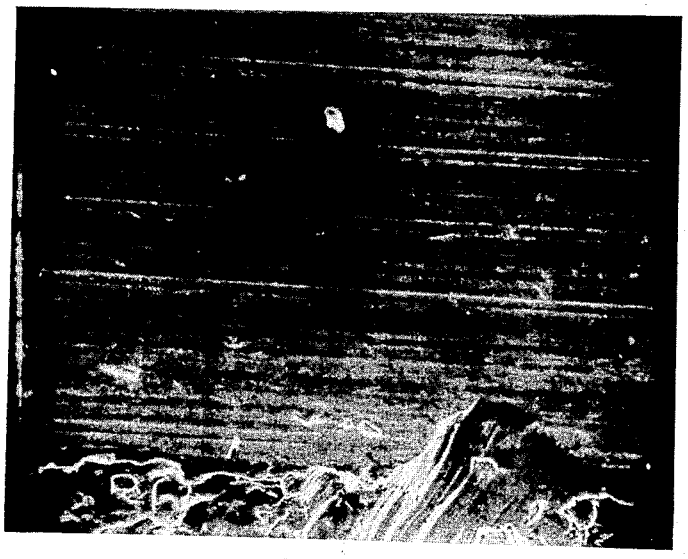
FIG. 4 is a photomicrograph of an edge view of a bearing after 75 hours additive use in a Briggs & Stratton engine—158X.
Figure 5:
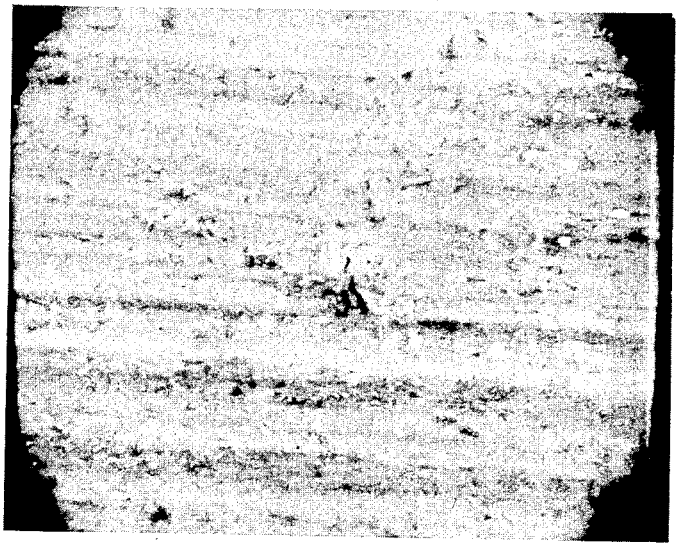
FIG. 5 is a photomicrograph of a bearing surface after 75 hours additive use in a Briggs & Stratton engine—750X.
Figure 6:
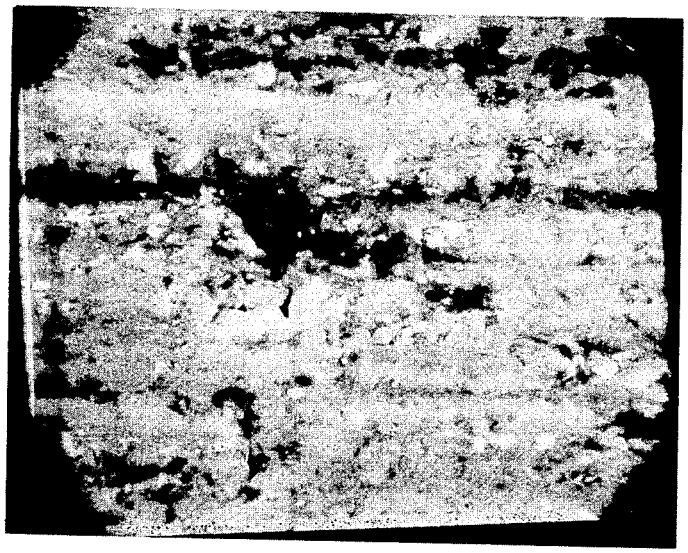
FIG. 6 is a photomicrograph of the pit in FIG. 5 at 160X.
Figure 7:
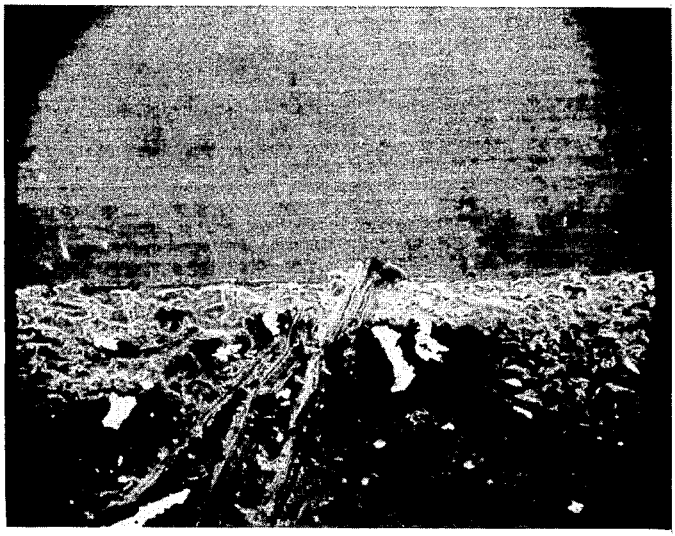
FIG. 7 is a photomicrograph of an edge view of a bearing before additive use in a Briggs & Stratton engine—40X.
Figure 8:
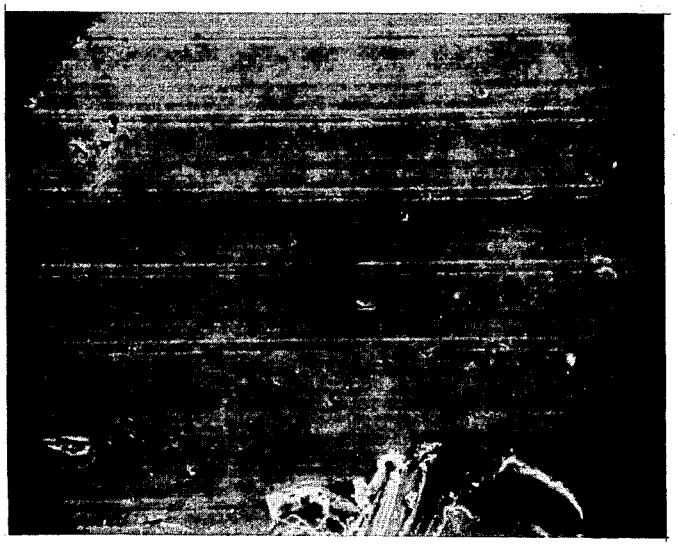
FIG. 8 is a photomicrograph of an edge view of a bearing before additive use in a Briggs & Stratton engine—160X.
Figure 9:
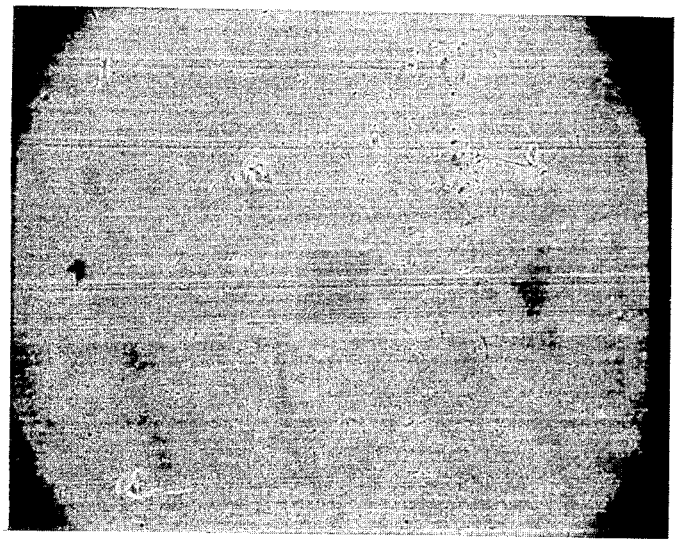
FIG. 9 is a photomicrograph of a bearing surface before additive use in a Briggs & Stratton engine—160X.
Figure 10:
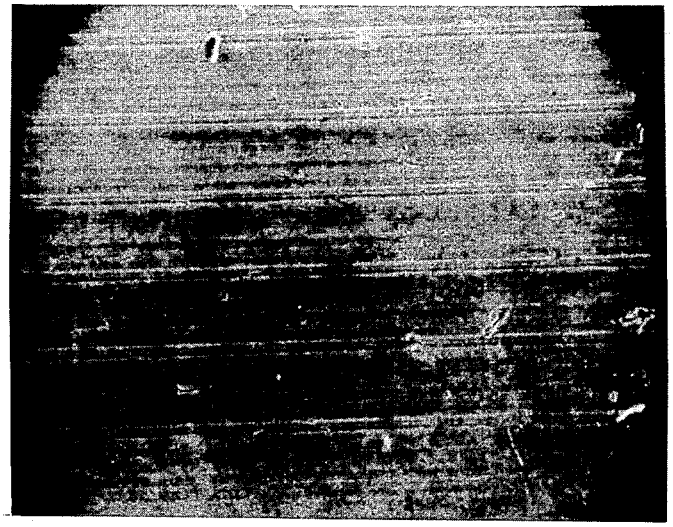
FIG. 10 is a photomicrograph of a bearing surface before additive use in a Briggs & Stratton engine—160.
Figure 11:
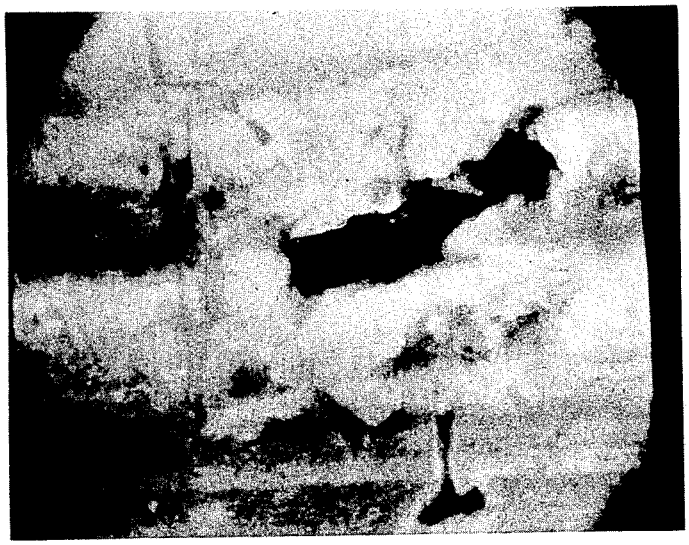
FIG. 11 is a photomicrograph of the pit seen in FIG. 4—4000X.
Figure 12:
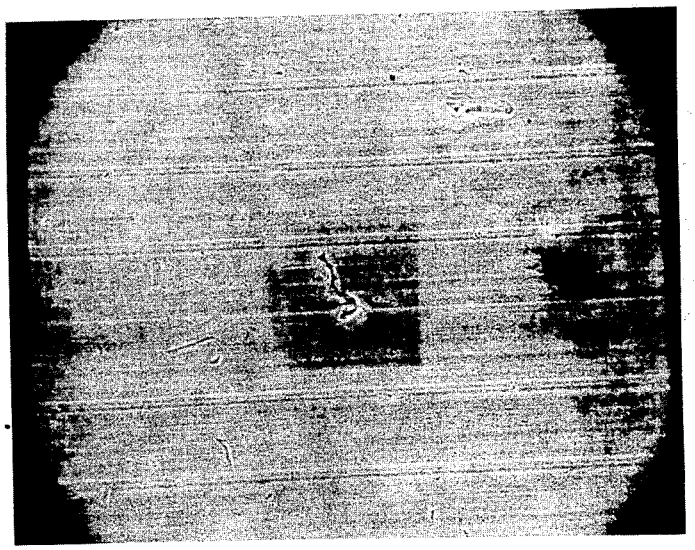
FIG. 12 is a photomicrograph of the pit seen in FIG. 4—160X.
Figure 13:
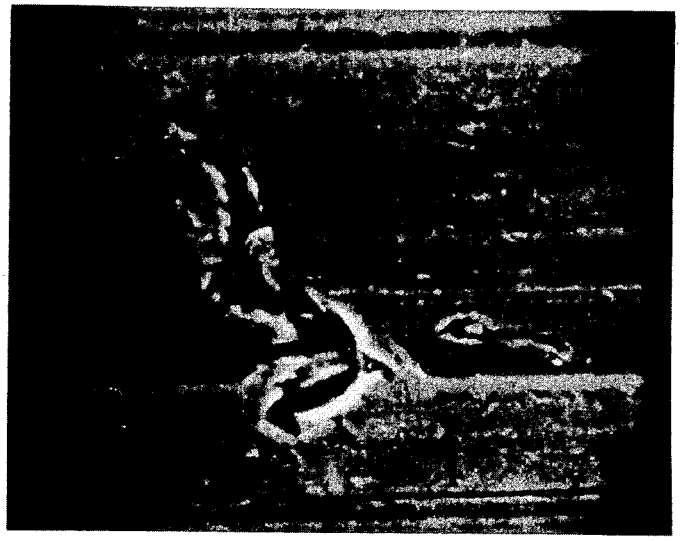
FIG. 13 is a photomicrograph of the pit seen in FIG. 12—800X.

Test Track: The tests provide a hands on analysis of the lubricants under conditions that simulate actual driving conditions. The test track consisted of a 3.5 mile long stretch of four lane divided highway. This particular stretch was chosen for its uniformity of surface, gentle curves, smooth traffic flow, ease of access and gentle inclines. FIGS. 1 and 2 graphically represent respectively a plan view and a view in elevation of the test track.

Distance and Speed Evaluation

All gas mileage test results are relative to the vehicle tested and not necessarily absolute. The odometer and speedometer of each test car was checked and calibrated. In the worst case, the odometer was off by 4% over actual readings and the speedometer was off 3.5% over actual speeds. In all cases, the odometer and speedometer readings were reproducible to 1.5%. All tests were driven by the same driver with speeds being controlled manually. The speeds were found to fluctuate between 48.5 and 51 mph over the test track. Test cars were equipped with secondary gasoline reservoirs inside the driver's compartment. The total volume of gasoline is visible within the reservoir. The reservoir is connected to the engine fuel line via a switch valve. Volume readings and change over were accomplished easily and smoothly within the driver's compartment. All fuel consumption readings were reproducible ±5 milliliter.

Environmetal Conditions

The gas mileage tests were conducted over an extended time period from warm summer months into cool fall months. On warm days, the tests were conducted in the early morning, with temperatures between 60° F. and 70° F. All tests were conducted on windless, sunny days with a relative humidity reading below 35%. On questionable days, the tests were repeated within 24 hours to establish confidency levels.

Mechanical Conditions

Prior to all tests, tire pressure, engine dwell, ignition points resistance, timing advance, and filters were inspected, replaced and/or adjusted as appropriate to maintain maximum operating conditions. The car weight was adjusted by adjusting the level of fuel in the main fuel tank. The gasoline used in all tests was purchased in bulk from a local supplier as "regular" with an octane rating of 87.

The following test sequence was followed and strictly adhered to:

a. Park at check point 1 and turn engine off.
b. Record internal fuel level, mileage, and operating temperature.
c. Place gasoline valve in "Tank" position for fuel flow.
d. Start car and proceed to check point 2 and stop.
e. Accelerate moderately to 50 mph.
f. Maintain 50 mph for 0.1 mile before starting test.
g. At predetermined mileage reading, turn gasoline valve to "Sample" position.
h. Maintain 50 mph speed for 3 miles.
i. At predetermined mileage reading, switch gasoline valve back to "Tank" position.
j. Slow, proceed to point 3 and stop.
k. Shut off engine. Repeat all readings and record data.
l. Start engine and proceed to point 4.
m. Accelerate moderately to 50 mph.
n. Maintain 50 mph for at least 0.1 mile before starting test.
o. At predetermined mileage reading, turn gasoline valve to "Sample" position.
p. Maintain 50 mph for 3 miles.
q. At predetermined mileage reading, switch gasoline valve to "Tank" position.
r. Slow, proceed to point 1 and turn engine off.
s. Take all necessary mileage and fuel readings.
t. Repeat entire sequence three times on any given day to complete mileage test.

Engine Evaluation

All engine parameters were monitored on sunny, warm days with engine at operating temperature. Duplicate readings were always taken and recorded. Cylinder compression readings were taken with two testers, one a screw-in type and the other, a compression-fit type. If both sets of readings were inconsistent or in variance, the test data was discarded, the check valves cleaned and the test repeated within 24 hours. Three readings were taken for each cylinder during compression tests.

Cold compression tests were performed in the morning hours, within 24 hours of a hot test series. The engines were allowed to stand over night, for at least 18 hours without operating prior to the testing.

Oil pressure readings were always taken under the specified engine rpm conditions. Emission readings were taken following "Emission Test" procedure. Tests were performed on sunny days with atmospheric temperature between 65° F. and 75° F.

The following procedure was followed in making emission tests:

a. Allow engine to obtain operating temperature by driving the automobile for 15 to 20 miles.
b. Allow engine to idle while hooking up the exhaust analyzer.
c. Allow analyzer to warm 5 minutes prior to adjustment.
d. Set the instruments to zero reading and span reading as per instructions.
e. Race engine to 2500 rpm for 1 minute and take readings.
f. Slow engine speed to 1000 rpm for 1 minute and take readings.
g. Repeat procedure twice.

Over the Road Engine Evaluation

Car #1
- 1972 Pinto Wagon
- 2 Liter Engine
- 4 Cylinders
- Standard Transmission
- Radial Tires (28 psi inflation pressure)
- Gas Mileage—Sustained 50 mph=34.1 mpg
- Vital Statistics
  - Over 100,000 miles of operation; no major overhauls
  - Oil Pressure (new oil)
    - 47 psi at 950 rpm
    - 55 psi at 2000 rpm
  - Idle 905 rpm
  - Fuel Pressure—5.5 psi
  - Timing—12° BTDC
  - Dwel—38°
  - Operating Temperature
    - Oil—198° F.
    - Water—198° F.
  - Emissions
    - Hydrocarbons—260–300 ppm
    - Carbon Monoxide—3–4%
  - Compression
    - Cylinder #1—129 psi
    - Cylinder #2—124 psi
    - Cylinder #3—128 psi
    - Cylinder #4—128 psi
  - Cranking amps (hot)
    - 225 initial
    - 125 final

TABLE I

Test Results: Car #1

| | | | | | | | | | | | | | |
|---|---|---|---|---|---|---|---|---|---|---|---|---|---|
| Miles on Oil Change | 0 | 1500 | 1600 | 1850 | 2400 | 3200 | 3800 | 4050 | 4500 | 4501 | 100 | 101 | 300 |
| Miles Since Additive Added | — | +0 | +100 | +350 | +900 | 1700 | 2300 | 2550 | 3000 | — | 3100 | — | 3300 |
| Gas Mileage, mpg | — | 34.1 | — | 36.0 | 36.1 | 36.1 | — | 35 | — | — | — | — | — |
| Gas Mileage, % Change | — | 0 | — | 5.6 | 5.9 | 5.9 | — | 2.6 | — | — | — | — | — |
| Compression, psi (Hot) | | | | | | | | | | | | | |
| #1 Cylinder | 129 | 129 | 131 | 133 | 136 | 139 | — | — | 128 | — | 131 | — | 132 |
| #2 Cylinder | 124 | 124 | 127 | 133 | 134 | 138 | — | — | 126 | — | 127 | — | 130 |
| #3 Cylinder | 129 | 128 | 136 | 136 | 136 | 140 | — | — | 135 | — | 137 | — | 137 |
| #4 Cylinder | 129 | 128 | 136 | 137 | 139 | 140 | — | — | 135 | — | 140 | — | 136 |
| Net Change, psi | — | — | 21 | 30 | 33 | 48 | — | — | 15 | — | 26 | — | 26 |
| Cranking amps** initial/final | 220/ 125 | 225/ 125 | 200/ 125 | 200/ 100 | 200/ 100 | 170/ 100 | 175/ 110 | — | 175/ 100 | — | 175/ 100 | — | 160/ 100 |
| Idle, rpm | 950 | 950 | 1050 | 1050 | 1050 | 1050 | 1100 | 1100 | 1050 | — | 850* | — | 105 |
| Oil Pressure at Idle | 48 | 47 | 48 | 47 | 42 | — | 44 | 43 | 43 | — | 49 | — | 49 |
| at Pressure | 52 | 52 | 54 | 51 | 47 | — | 47 | 47 | 47 | — | 56 | — | 57 |
| Emission CO, % | — | 3–4 | 2 | 2 | 2 | 1.5–2 | — | 3.5 | 1.9 | — | 2.0 | — | 1.7 |
| Hydrocarbons,ppm | — | 260–300 | 230–260 | 200 | 190–220 | 300 | — | 325 | 280 | — | 300 | — | 200 |
| Oil Consumption | — — | add 5 oz. Additive | add 1 qt. | — — | add 1 qt. | — — | add 1 qt. | — — | add 1 qt. | oil changed | — — | add 5 oz. additive | — — |

| | | | | | | | | | |
|---|---|---|---|---|---|---|---|---|---|
| Miles on Oil Change | 1000 | 2500 | 3100 | 3200 | 300 | 301 | 700 | 1100 | 1600 | 2000 |
| Miles Since Additive Added | 4300 | 5800 | 6400 | — | 6800 | — | 7200 | 7600 | 8100 | 8500 |
| Gas Mileage, mpg | 37.3 | — | — | — | 36.0 | — | — | — | 37.0 | — |
| Gas Mileage, % Change | 9.4 | — | — | — | 5.3 | — | — | — | 8.2 | — |
| Compression, psi (Hot) | | | | | | | | | | |
| #1 Cylinder | 132 | 131 | *127 | — | 130 | — | 129 | 135 | 136 | — |
| #2 Cylinder | 128 | 122 | 124 | — | 128 | — | 124 | 124 | 125 | — |
| #3 Cylinder | 137 | 136 | 132 | — | 127 | — | 134 | 137 | 137 | — |
| #4 Cylinder | 139 | 127 | 129 | — | 127 | — | 135 | 132 | 129 | — |
| Net Change, psi | 27 | 7 | 3 | — | 3 | — | 13 | 19 | 18 | — |
| Cranking Amps initial/final | 180/ 100 | 175/ 100 | 175/ 100 | — | — | — | — | 170/ 100 | 170/ 100 | — |
| Idle, rpm | 1000 | 1000 | 950 | — | — | — | 1000 | 1050 | 1050 | — |
| Oil Pressure at Idle | 47 | 45 | 42 | — | — | — | 45 | 42 | 42 | — |
| at 2000 rpm | 53 | 51 | 49 | — | — | — | 50 | 48 | 48 | — |
| Emission CO, % | 2.0 | 2.2 | 1.6 | — | — | — | — | — | 2.0 | — |
| Hydrocarbons, ppm | 300 | 310 | 150 | — | — | — | — | — | 175 | — |
| Oil Consumption | add 1 qt. | — | — | Oil changed | — | add 5 ozs. additive | — | — | — | Oil OK |

*Characteristics of compression generated by engine has changed, see discussion
**Measured for hot engine only Selected parts of the engine from automobile #1 were removed and examined with a scanning electron microscope. The object is to inspect wearing surfaces for corrosion, errosion or other visual effects of surface wear or deterioration.

Car #2
- 1965 Chevelle Station Wagon
- 283 Cubic Inches
- 8 Cylinders
- Automatic Transmission
- Bias belted tires (30 psi inflation pressure)
- Vital Statistics
  - Over 100,000 miles of continuous operation with no major overhauls
  - Oil Pressure (new oil)
    - 26 psi at idle
    - 34 psi at 2000 rpm
  - Idle 950 rpm
  - Fuel Pressure—5.8 psi
  - Timing—10° BTDC
  - Dwel—30°
  - Operating Temperature—192° F.
  - Emissions
    - Hydrocarbons—500 ppm
    - Carbon Monoxide—7.2%
  - Compression:

| Cylinder | Hot | Cold |
|---|---|---|
| 1 | 120 | 120 |
| 2 | 139 | 114 |
| 3 | 123 | 107 |
| 4 | 136 | 100 |
| 5 | 130 | 107 |
| 6 | 119 | 97 |
| 7 | 126 | 110 |
| 8 | 127 | 110 |

Cranking Amps 100/135

TABLE II

Test Results: Car #2

| | | | | | | | | | |
|---|---|---|---|---|---|---|---|---|---|
| Miles on Oil Change | 0 | | 100 | | 200 | 400 | | 700 | 1000 |
| Miles Since Additive Added | 0 | | — | | 200 | 400 | | 700 | 1000 |
| Gas Mileage, mpg | 20.1 | | — | | 21.5 | — | | 21.8 | 21.8 |
| Gas Mileage, % Change | 0 | | — | | 7.0 | — | | 8.5 | 8.5 |
| Compression, psi | Hot | Cold | Hot | Cold | | Hot | Cold | | |
| #1 | 120 | 120 | 130 | 123 | — | 130 | 124 | — | — |
| #2 | 130 | 114 | 135 | 127 | — | 135 | 127 | — | — |
| #3 | 139 | 107 | 138 | 135 | — | 148 | 136 | — | — |

TABLE II-continued

| Test Results: Car #2 | | | | | | | | | |
|---|---|---|---|---|---|---|---|---|---|
| #4 | 119 | 100 | 123 | 104 | — | 130 | 105 | — | — |
| #5 | 123 | 107 | 137 | 123 | — | 140 | 123 | — | — |
| #6 | 126 | 97 | 125 | 110 | — | 123 | 111 | — | — |
| #7 | 136 | 110 | 137 | 133 | — | 137 | 131 | — | — |
| #8 | 127 | 110 | 127 | 124 | — | 124 | 127 | — | — |
| Cranking Amps initial/final | 200/135 | | | | 180/130 | 180/130 | | 180/130 | — |
| Idle, rpm | 950 | | 975 | | 975 | 1050 | | 1050 | — |
| Oil Pressure at Idle | 26 | | 26 | | 26 | 26 | | 25 | — |
| at 2000 rpm | 33 | | 35 | | 34 | 34 | | 34 | — |
| Emission CO, % | 7.2 | | 5.2 | | — | 5.1 | | 5.0 | — |
| Hydrocarbons, ppm | 500 | | 480 | | — | | | | — |

TABLE III

Test Results: Car #3
Make: AMC Rambler Station Wagon V-8 Engine
Cold Compression Test, psi

| Cylinder | Mileage 99362 Before Additive Added | Mileage 99825 463 miles After Additive Added |
|---|---|---|
| 1 | 144 | 158 |
| 2 | 133 | 150 |
| 3 | 145 | 150 |
| 4 | 140 | 145 |
| 5 | 137 | 143 |
| 6 | 148 | 412 |
| 7 | 145 | 145 |
| 8 | 150 | 150 |
| Total | 1142 | 1183 |

TABLE IV

Test Results: Car #4
Make: Toyota Celica, 2 door coupe, 5 speed
4 cylinders, 2168 cc overhead cam

| Cylinder | Mileage 43265 | Mileage 43675 | Mileage 45543 |
|---|---|---|---|
| 1 | 137 | 145 | 137 |
| 2 | 128 | 135 | 146 |
| 3 | 142 | 143 | 144 |
| 4 | 117 | 135 | 144 |
| Oil Consumption | 1 qt/250 miles | 1 qt/1000 miles | 1 qt/2000 miles |

The engine in automobile #1 was known to leak a quart of oil every 1500 to 2000 miles. Some oil consumption was also attributed to oil burning.

The oil consumption results seen in Table I can be attributed to these causes. It will be noted that the oil consumption gradually decreased until it was effectively stopped. The oil consumption was reduced due to less oil burning, see emission readings, and reduction of leakage. Leakage analysis was qualitative as the engine stopped dripping oil when at rest. Baseline compression readings showed that all four cylinders were in acceptable condition, with one cylinder being low. The operating conditions of this engine were acceptable, especially considering the high mileage, i.e. 101,000 miles.

The test data pin points several important results due to the addition of the additive to the crankcase of the engine. An immediate increase in compression was noted in all cylinders. The compression not only increased but leveled out among the four cylinders. This is, of course, an advantageous situation as it represents a possible increase in horsepower and reduction of engine blow by.

Addition of oil to the crankcase continually diluted the additive. The degree of dilution is relative to the oil loss due to leakage rather than oil burning. Most oil burning is due to oil volatilization and combustion which would affect the additive quantity very little. Reduction in additive concentration is evidenced by the compression reading having reached a maximum followed by slow reduction in parameters. One would also expect a parameter decrease due to oil degradation in any engine.

Gas mileage increases, idle increases, emission readings and cranking amps decreases followed the same trend as did the compression readings. In all cases, the parameter improved to a maximum or a minimum in case of cranking amps and emission readings, followed by a slow decrease. The trend was again reversed when the oil was changed and additional additive was added.

The second oil change (third additive addition) similarly reversed the trend. With no oil loss, the parameter appears to be stabilizing; however, the compression readings are not level and certain unusual characteristics were observed.

At the 6400 mile point after additive addition, slight blue smoke was produced from the engine upon cold start up. This was not observed during warm starting. Similarly, the compression reading became a little inconsistent. It was noted that up to 15 engine cycles were necessary to maximize compression reading, where 5–7 cycles were required at the beginning of the test series.

Cranking amps reductions and idle increases associated with additive addition to the crankcase strongly suggest a reduction of friction within the engine. These results are also consistent with compression and horsepower increases. Increases in this area are more significant than oil viscosity changes as a result of the additive.

The oil pressure readings as represented are not very meaningful. This is primarily a result of gradual oil oxidation and fuel dilution. Two sets of results are meaningful. Readings taken with new oil in the crankcase, in the absence of additive, would reflect the actual condition within the engine because the oil should be identical at these stages. Note the oil pressure readings taken at 0 miles and at 100 miles (3100). The actual oil pressure of the new oil had increased 4 psi at 2000 rpm (and possible reduction in 2 psi at 1000 rpm). These results suggest a reduction in main bearing play and general improvement of the oil distribution system.

In the tests there has been a consistent and dramatic increase in gas mileage with the addition of additive to the crankcase. Improvements of up to 9.4% were observed. These are significant. It has also been observed that there has been an overall decrease in carbon monoxide and hydrocarbon emissions from the test vehicle. It is difficult to quantify these changes due to the wide range of variables present; however, reduction is consistent and significant as demonstrated by test results.

Car #2: Car #2 was studied in a similar fashion to car #1. The car history was well known. The automobile was equipped in like fashion to car #1. The results are also similar. Compression, mileage, idle and oil pressure increases were observed. Similarly, a cranking amp decrease and emission decrease were observed. No detrimental effects were observed. Gas mileage increase of 8.5% is significant. It was difficult to assess the oil consumption for this test car due to short test period.

Car #3: Test car #3 was evaluated only on a limited basis. The results over a 500 mile test period show significant increase in engine compression. In this case, the engine was in good condition at the beginning of the test. A total increase in compression of 3.6% was noted.

Car #4: Test car #4 was the best evaluation for oil consumption. The engine smoked visibly and consumed one quart of oil every 250 miles during the previous several thousand miles of operation. After addition of additive to the crankcase at oil change, only one quart of oil was consumed over the next 1000 miles of operation—a 600% reduction, and 1 quart over the next 2000 miles.

This test engine had one bad cylinder. Cylinder #4 was of low compression. Overall compression balance was poor. After the addition of additive, the overall compression balance was much improved. A general increase in compression of 47 psi units was noted.

TABLE V

LABORATORY TESTS

Oxidation Stability Test:

40 weight Pennzoil was chosen as the standard oil to be used in this test series. Test temperature was 375° F.

Viscosity, CS at 100° F.

| Test Duration | Pennzoil | Pennzoil + Additive |
|---|---|---|
| 0 min. | — | 181.0 |
| 30 min. | 154.9 | 150.9 |
| 60 min. | 157.0 | 152.8 |
| 180 min. | 163.0 | 158.7 |
| 300 min. | 168.2 | 165.3 |
| % Change | 8.59 | 9.54 |

Spot Test; Oxidation

| Test Duration | Pennzoil | Pennzoil + Additive |
|---|---|---|
| Original Blend | neg | neg |
| 30 min. | neg | neg |
| 60 min. | neg | neg |
| 180 min. | neg | neg |
| 300 min. | neg | neg |

Viscosity Analysis

| | sus@ 100° F. | sus@ 212° F. | Index | % Change in Viscosity @100 |
|---|---|---|---|---|
| HL #77-461-1 Pure Havoline 10W-40 | 430 | 75 | 138 | — |
| HL #77-461-2 Havoline 10W-40 +6.4% Additive | 476 | 76 | 133 | 10.7 |
| HL #77-461-3 Havoline 10W-40 +16% Additive | 549 | 77 | 124.5 | 27.7 |
| HL #77-461-4 Additive | >4000 | — | — | >1000 |
| HL #77-461-5 Dispersing oil extracted from Additive | 478 | — | — | 11.0% |

TABLE VI

Oil Analysis of Lubricant used in Briggs and Stratton Engine Bench Test (New Oil: Pennzoil 40W):

| | New Oil | New Oil + Additive | 25 hours in use | 75 hours in use |
|---|---|---|---|---|
| Viscosity, cs @ 210° F. | 15.3 | 15.3 | 15.1 | 17.2 |

TABLE VI-continued

| | | | | |
|---|---|---|---|---|
| Viscosity, cs @ 100° F. | 158.7 | 166.5 | 148.8 | 174.4 |
| Viscosity Index | 104.8 | 100.3 | 102.9 | 111 |
| Pour Point, °F. | 5 | 10 | 15 | 20 |
| Flash Point, COC °F. | 435 | 430 | 365 | 380 |
| API Gravity | 27.3 | 26.8 | 26.6 | 21.2 |
| Carbon Residue, % | 1.52 | 1.68 | 2.89 | 6.11 |
| Ash, % by wt. | 0.81 | 1.40 | 1.76 | 4.85 |

Internal Wear Measurements from Briggs and Stratton Engine:

| | Operation Time = 0 | After 75 Hours Operation with Additive Added |
|---|---|---|
| Crankshaft Diameter | 0.9986" | 0.9986" |
| Camshaft Diameter | | |
| Front Lobe | 0.9081" | 0.9080" |
| Back Lobe | 0.9076" | 0.9073 |
| Push Rod Diameter | | |
| Front | 0.2470" | 0.2469" |
| Back | 0.2461" | 0.2461" |
| Cylinder Wall | Clean, honing marks visible | Clean with a heavy ring ridge, honing marks still visible |

Elemental Analyses of Oil from Briggs and Stratton Engine:

| | New Oil | Used Oil, 75 Hours |
|---|---|---|
| Lead | 1.0 ppm | 6800 ppm |
| Copper | 1.0 ppm | 3200 ppm |
| Carbon Residue Found on Piston at 75 Hours | | |
| Lead | 42% | |
| Copper | 0.4% | |
| Crankcase Sediment, after 75 Hours Operation | | |
| Lead | 17.64% | |
| Copper | 49.50% | |

The main rod bearing from Briggs and Stratton engine was examined before the addition of additive to the engine. The bearing was examined again after additive was added and the engine was operated for 75 hours. Photographs of FIGS. 3–6 are of the bearing after 75 hours of operation with additive in the crankcase of the engine. Photographs of FIGS. 7–13 are of the bearing prior to the addition of additive.

The score mark seen in the lower part of photographs of FIGS. 7, 8, 12 and 13 was artificially placed there in order to relocate that position on the bearing surface after the engine was reassembled and operated for 75 hours.

It is clear from these pictures that the machining and molding marks are still visible on the bearing surface after 75 hours of operation. Some corrosion is seen in photographs of FIGS. 4 and 6. The sharp edges of the score marks and pits are rounded. This feature would be typical due to oil degradation and corrosion. No abrasive score marks can be seen. Pitting marks have changed due to surface wear; however, total material loss is insignificant.

The major observable change is the number of surface pits. Used bearing shows many more pits. Pits due to corrosion are results of normal oil degradation.

The bearing was examined by X-ray after operation in the engine with additive for 75 hours. No lead or copper was identified on the surface at that time. Similarly no lead or copper was found impregnated in the bearing surface.

| Gasoline Consumption, Briggs and Stratton Engine | |
|---|---|
| Normal Operation | 5.0 hours/gal. |
| After additive | 5.22 (average over 17 tanks) |

-continued

| Gasoline Consumption, Briggs and Stratton Engine |
|---|
| hours/gal. |

Figure 15:
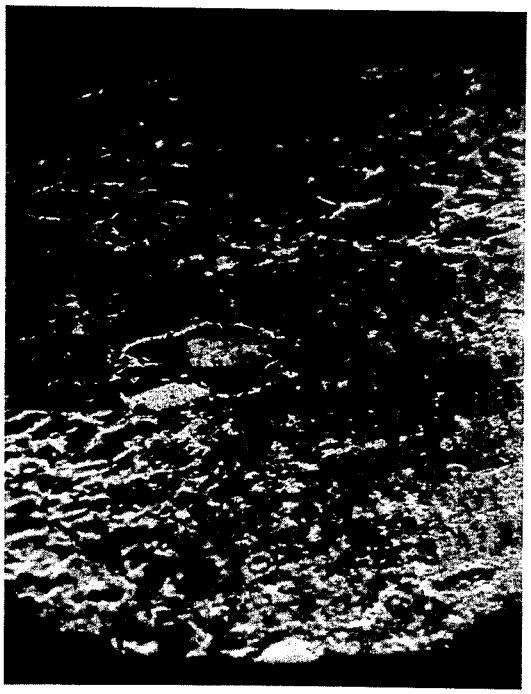
FIG. 15 is a photomicrograph of a bearing from test car #1 with use of additive.

A sample of the additive was filtered, and the particulates were examined by SEM. The particles were found to be spherical. The dimensions of the particles, FIG. 15, are as follows:

| | Copper Particles | Lead Particles |
|---|---|---|
| Size | 5.9–8.2 microns in diameter | 2.3–2.7 microns in diameter |
| Shape | spherical | spherical |

Figure 17:
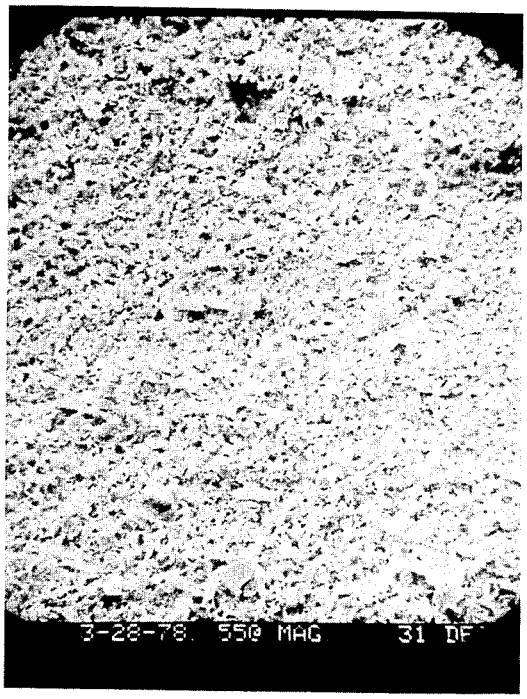
FIG. 17 is a photomicrograph showing the particle size distribution of the additive after use in test car #1—500X; and, FIG. 18 is a photomicrograph of the additive after use in test car #1 as seen in FIG. 17—5500X.
Figure 14:
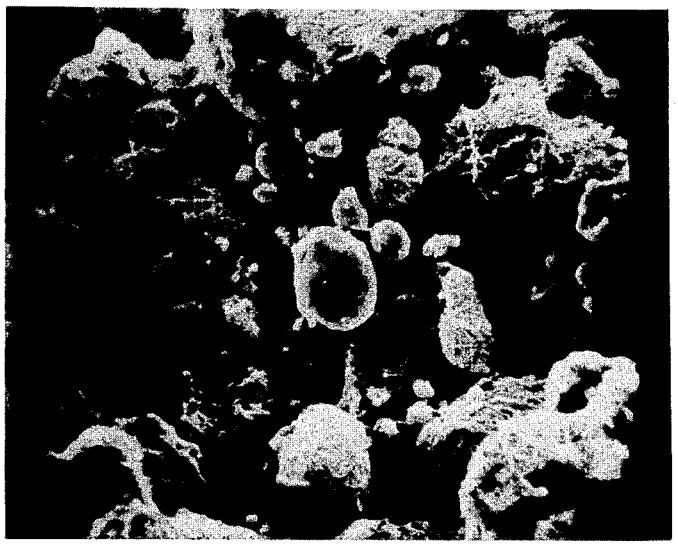
FIG. 14 is a photomicrograph showing the particle distribution of additive contents prior to use; large particle in the center is copper and small spheres are lead; strings are filter material.
Figure 18:
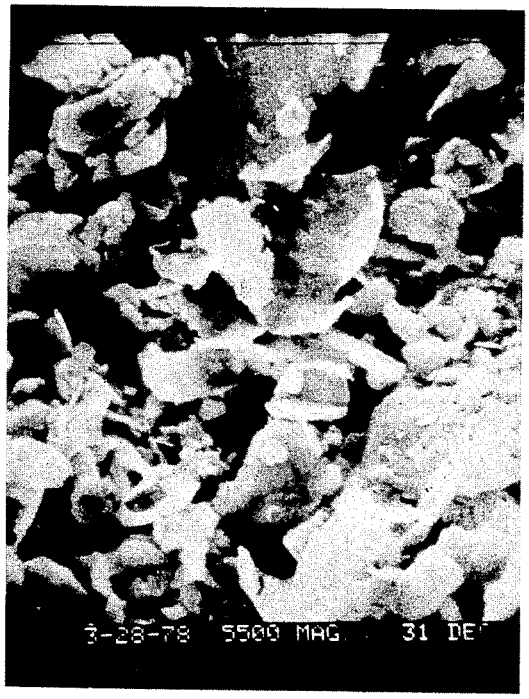

A sample of oil from test car #1 engine test was similarly filtered and examined by SEM. In this case, all of the particles were flat and regular, FIGS. 17 and 18. The general appearance was that of smashed wax droplets. Both copper and lead particles were present, as determined by X-ray analysis.

Oxidation Stability

The test results demonstrate that the rate of oxidation of Pennzoil in the presence of additive is enhanced over the rate of oxidation of just Pennzoil 10 W-40 wt. oil. The rate was determined to be 11% faster in the presence of additive; however, the parameters of the experiment preclude accuracy of measurement greater than 10%. Therefore, the overall enhancement of oxidation is not great and should not be a concern.

Viscosity Analyses

Relative to pure Havoline 10 W-40 wt. motor oil, the addition of the additive increases the viscosity of the oil. At elevated temperatures the change is very small as can be seen by the data. At lower temperatures, the change in oxidation is more significant. The overall change is reflected in the change of the viscosity index.

Increased viscosity at elevated temperatures is not a problem if moderate. Similarly moderate increases at low temperatures is not a problem. The viscosity change evidenced for additive is moderate at 100° F. and very small at 212° F. It is likely that this would not produce any problems. If concern over this feature were an issue, lighter weight oil could be substituted for the heavier oil when additive is to be used.

Bench Test; Oil Analyses

The oil used in the Briggs and Stratton bench tests were analyzed as seen in Table V. Mild oxidation of the crankcase oil was seen with time of use. This is normal. The degree and rate of oxidation is of interest in that it has previously been established that additive may enhance the rate of oxidation of crankcase oils. The degree of oxidation found in this bench test is mild and not a problem. Under normal frequencies of change, this degree of oxidation would not be a problem.

Bearing Analyses

Internal wear measurements were made on the crankshaft, camshaft, and push rods of the Briggs and Stratton engine before and after the bench tests. As can be seen in the appropriate chart, no significant wear was observed.

Close examination of the crankshaft bearings demonstrates some wear and errosion of the surfaces. The degree of wear is not significant. No plating of the bearing surface was observed. Pitting and scrapping was minimal. The honing marks were still visible on the cylinder walls.

Figure 16:
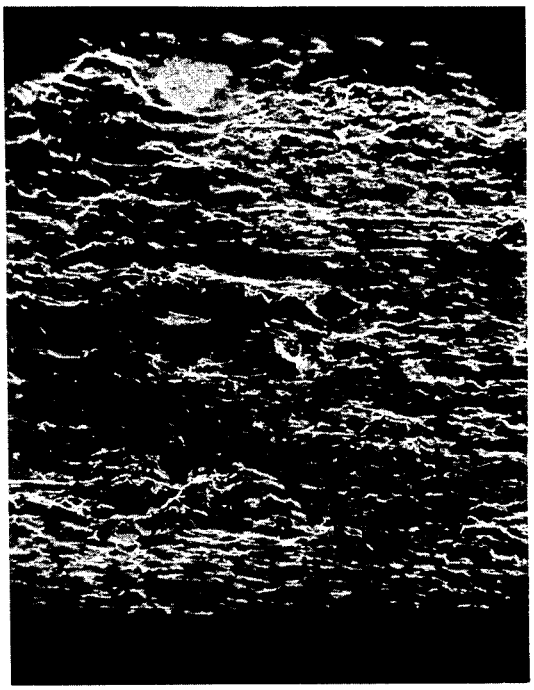
FIG. 16 is a photomicrograph of another bearing from test car #1 after additive use.

The crankshaft bearings from the engine in test car #1 were also examined by scanning electron microscopy, FIGS. 15 and 16. In this case, minimal engine wear was also noted. At the fringe of the bearings near the oil grooves, copper colored marks were clearly visible with the naked eye. Closer examination proved these marks to be small pits and scratches which have been filled with copper metal.

The copper metal found in the additive lubricant has been deposited in the pits at these locations. Nowhere else on the bearings were these pits observed. Similarly, nowhere else on the bearing were copper marks observed.

The test results in conjunction with the SEM evaluation of the new and used additive suggest a novel mechanism of action. The particles dispersed in the additive are initially spherical. Under normal circulation with no high pressure applied in surface lubrication, the particles remain round. Under these conditions enhancement of boundary lubrication might be expected. During high pressure applications, the ductile copper and lead present are deformed and flattened as seen in photographs of FIGS. 17 and 18. It is anticipated that these flat particles function similarly to graphite in that they would slide over each other in layered fashion. The ductility of the material would also allow the particles to be reshaped during use to conform to the surrounding geography. This would explain why a certain "break in" period is required before the full potential of the additive is realized. Disorientation of the particles would occur when the engine was not in operation. A time lag for reorientation would be necessary upon re-start of the engine. This explains mild smoking upon cold start-up and the change in compression characteristics in test car #1.

While there has been described what at present are considered to be the preferred embodiments of the invention, it will be obvious to those skilled in the art that various changes and modifications may be made therein without departing from the invention. It is aimed therefore, in the appended claims to cover all such changes and modifications which fall within the true spirit and scope of the invention.

What is claimed is:

1. A lubricant additive composition comprising a lubricating liquid carrier containing an effective amount of a mixture of powdered copper and lead metal particles of spherical configuration not more than 20 microns in diameter.

2. The lubricant additive composition of claim 1 wherein the mixture of copper and lead powder comprises from about 20% to about 80% copper and from about 80% to about 20% lead.

3. The additive of claim 1 wherein the liquid carrier is a petroleum base oil.

4. The additive of claim 1 wherein the liquid carrier contains an effective amount of a multipurpose grease.

5. The additive of claim 1 wherein the metal particles are present in the amount of from about ½ ounce to about 3 ounces in 5 ounces of carrier liquid.

6. The additive of claim 3 wherein the oil is from 20 w to 40 w in weight.

7. The additive of claim 1 wherein 90% of the metal particles are 20 microns or less in diameter.

8. The additive of claim 2 wherein the metal particle mixture is about 60% copper and about 40% lead.

9. The additive of claim 3 wherein the oil is 40 w high grade oil containing about 1¾ ounces of metal particles in the ratio of about 60% copper and about 40% lead particles not more than about 20 microns in diameter to about 3¼ ounces of oil.

10. The additive of claim 4 wherein the grease is present in an amount of about 1 pound of grease to about 32 ounces of metal particles.

11. The additive of claim 4 wherein the grease is present in an amount of about 2½ pounds of grease to each gallon of carrier.

12. The additive according to claim 2 wherein the copper particles are from about 5 to about 10 microns and the lead particles are about 2 to about 3 microns in diameter.

13. The additive of claim 4 wherein the grease is present in an amount of about 1 pound of grease to about 16 ounces of metal particles.

14. The additive of claim 4 wherein the grease is present in an amount of about 1 pound of grease to about 1 to about 2 ounces of metal particles.

15. The additive of claim 1 wherein the metal particles include an effective amount of an anti-oxidant thereon.

16. The additive of claim 3 wherein the metal particles have an effective amount of an anti-oxidant coated thereon.

17. The additive of claim 9 wherein the metal particles have an effective amount of an anti-oxidant coated thereon.

* * * * *